US006153116A

United States Patent [19]

Yang et al.

[11] Patent Number: 6,153,116

[45] Date of Patent: Nov. 28, 2000

[54] METHOD OF DETECTING END POINT AND MONITORING UNIFORMITY IN CHEMICAL-MECHANICAL POLISHING OPERATION

[75] Inventors: Ming-Cheng Yang, Taipei; Feng-Yeu Shau, Tainan Hsien; Cheng-Sung Huang, Feng-Yuan; Champion Yi, Hsinchu Hsien, all of Taiwan

[73] Assignee: United Microelectronics Corp., Hsinchu, Taiwan

[21] Appl. No.: 09/183,446

[22] Filed: Oct. 30, 1998

[30] Foreign Application Priority Data

Aug. 18, 1998 [TW] Taiwan ..... 87113553

[51] Int. Cl.[7] ..... B24B 49/12; H01L 21/00; B44C 1/22

[52] U.S. Cl. ..... 216/85; 216/84; 438/14; 438/16

[58] Field of Search ..... 216/84, 85; 438/14, 438/16

[56] References Cited

U.S. PATENT DOCUMENTS 5,413,941 5/1995 Koss et al. ..... 437/8

5,433,651 7/1995 Lustig et al. ..... 451/6

5,658,423 8/1997 Angell et al. ..... 438/9

*Primary Examiner*—Randy Gulakowski

*Assistant Examiner*—Shamim Ahmed

*Attorney, Agent, or Firm*—Hickman Coleman & Hughes, LLP

[57] ABSTRACT

A method of monitoring the state of chemical-mechanical polishing that can be applied to the polishing of a metallic layer over a substrate. The method includes performing a series of scanning operations while a wafer is being polished to generate multiple reflectance line spectra in each polishing period. The degree of dispersion of the reflectance spectra is then utilized as a polishing index. In this invention, the standard deviation of the reflectance spectra in each period is used as a monitoring index, and the peak value of the standard deviation is used to determine the polishing end point. Surface uniformity is monitored by using the time interval between two time nodes at half the peak standard deviation values. When the distance of separation between the two time nodes is large, it means that the polished surface is not sufficiently flat.

16 Claims, 6 Drawing Sheets

METHOD OF DETECTING END POINT AND MONITORING UNIFORMITY IN CHEMICAL-MECHANICAL POLISHING OPERATION

CROSS-REFERENCE TO RELATED APPLICATION

This application claims the priority benefit of Taiwan application serial no. 87113553, filed Aug. 18, 1998, the fill disclosure of which is incorporated herein by reference.

BACKGROUND OF THE INVENTION

1. Field of Invention

The present invention relates to a method of monitoring chemical-mechanical polishing operation. More particularly, the present invention relates to a method of monitoring chemical-mechanical polishing operation using standard deviation of reflectance spectra as a monitored value.

2. Description of Related Art

As the level of integration of semiconductor devices increases, demand for precision finished products also soars. One of the major factors in determining the quality of devices is the degree of uniformity of a silicon wafer before photolithographic processing. Currently, chemical-mechanical polishing (CMP) is one of the most important processing steps for planarizing a silicon wafer in semiconductor production. In fact, chemical-mechanical polishing is capable of global surface uniformity. However, a large number of factors can affect the degree of uniformity in a CMP operation. One critical factor is the capacity to monitor the polishing end point in a polishing operation.

The dual damascene process is a commonly applied technique for fabricating highly integrated semiconductor circuits. FIG. 1 is a cross-sectional view showing a dual damascene structure formed by a conventional dual damascene process. First, as shown in FIG. 1, a metallic layer 12 such as aluminum or polysilicon is formed above a substrate 10, and then a dielectric layer 14 such as an oxide layer is deposited over the metallic layer 12. Thereafter, photolithographic and etching operations are conducted twice to form openings 18*a*, 18*b* and 20. The opening 18*a* acts as a via for coupling with the metallic layer 12, whereas a conductive material will be subsequently deposited into the openings 18*b* and 20 to serve as metallic interconnects.

Next, a barrier layer 22, for example, a titanium nitride/titanium (TiN/Ti) composite layer, is formed over the sidewalls and bottoms of the openings 18*a*, 18*b* and 20. Subsequently, metal such as tungsten is deposited to fill the openings 18*a*, 18*b* and 20 to form a metallic layer 24. Thereafter, using the barrier layer 22 and the dielectric layer 14 as a polishing stop layer, the metallic layer 24 is polished using a chemical-mechanical polishing method. Ultimately, a portion of the metallic layer 24 above the dielectric layer 14 is removed, forming a metallic plug. In the CMP operation, precise control of the polishing end point is a very important factor that deeply affects the quality of the surface finish. If polishing is stopped too early, metallic residue from the metallic layer 24 will remain above the dielectric layer 14, leading to possible bridging of neighboring circuits.

On the contrary, if the polishing operation is stopped too late, over-polishing of the metallic layer 24 will occur, leading to the formation of a concave surface (i.e., dishing of the surface as indicated by arrows 26 in FIG. 1).

In addition, in a dual damascene processing technique, over-polishing of the metallic plug will severely affect its sheet resistance. However, to ensure no residual metal will remain above the dielectric layer, some over-polishing is necessary. Therefore, for better monitoring of the polishing end point, one must rely on a highly reliable in situ end point detector (EPD). Note also that a conventional end point detector is capable of monitoring the polishing end point only. The end point detector is incapable of obtaining information such as the degree of uniformity of a polished wafer. Hence, if uniformity information is really needed, the wafer has to be inspected offsite with other instruments such as a profilometer or a microscope after the polishing operation has finished. Consequently, extra time is needed for inspection, and the information concerning the degree of uniformity cannot be immediately fed back to produce a precisely polished surface.

In light of the foregoing, there is a need for an improved method of monitoring the polishing end point and degree of uniformity while a chemical-mechanical polishing operation is being carried out.

SUMMARY OF THE INVENTION

Accordingly, the present invention is to provide a method of monitoring the polishing end point in a chemical-mechanical polishing operation so that the exact polishing end point is reliably obtained.

In another aspect, the invention is to provide a method of continuously monitoring the degree of uniformity of a silicon wafer being polished while a chemical-mechanical polishing station is used so that information about the surface uniformity of the wafer can be immediately fed back to the polishing station to improve the quality of the surface finish.

To achieve these and other advantages and in accordance with the purpose of the invention, as embodied and broadly described herein, the invention provides a method of monitoring a chemical-mechanical polishing operation, especially for polishing a metallic layer above a substrate. The method of monitoring includes constant sampling of reflectance spectra from a substrate surface while the polishing operation is carried out so that reflectance line spectra within a given period are obtained. Subsequently, the degree of dispersion of the reflectance spectra in each period is used as a means of monitoring the polishing operation. In this invention, the calculated standard deviation of the reflectance spectra within a given period is used as a monitoring index. In fact, the peak value of the standard deviation is used to determine the end point of the polishing operation. In addition, the degree of surface uniformity is monitored by the distance of separation between two time nodes, wherein the time nodes are taken at half the value at the peak standard deviation. The relationship between distance of separation between the two time nodes and the degree of surface uniformity is such that the larger the distance between the two time nodes, the worse the degree of uniformity of the polished surface.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
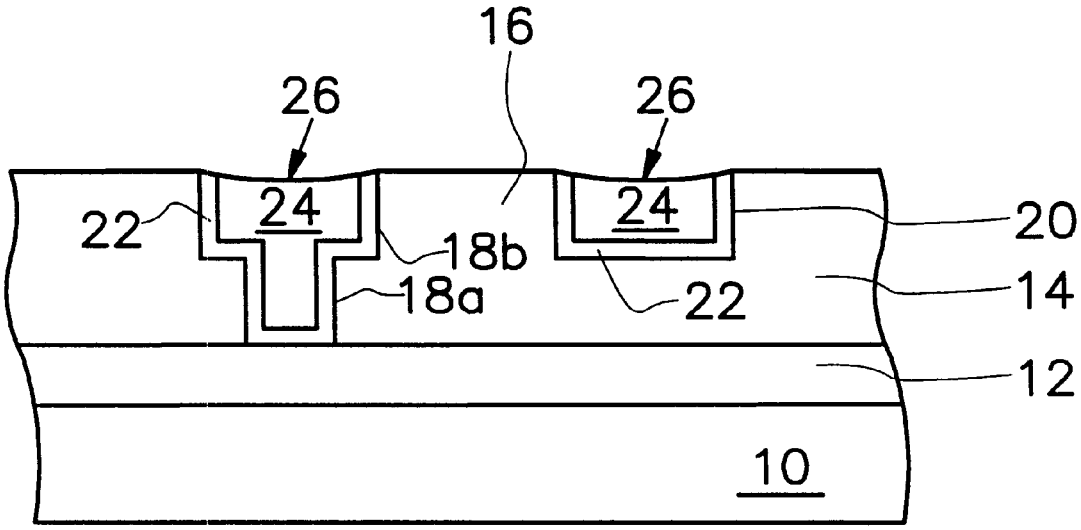
FIG. 1 (PRIOR ART)
FIG. 1 is a cross-sectional view showing a dual damascene structure formed by a conventional dual damascene process.

Reference will now be made in detail to the present preferred embodiments of the invention, examples of which are illustrated in the accompanying drawings. Wherever possible, the same reference numbers are used in the drawings and the description to refer to the same or like parts.

Conventional methods of detecting the end point of a chemical-mechanical polishing operation include: (1) Using the temperature of the polishing pad as a monitoring base; (2) Using the coefficient of friction of the polishing surface as a monitoring base; and (3) Using reflectivity from the polishing surface as a monitoring base. In the first method, differences in frictional coefficients between the metallic layer and the dielectric layer with respect to the polishing pad are utilized to generate different amounts of heat. Hence, there is a temperature difference when a metallic layer instead of a dielectric layer is polished. Therefore, by using a heat-sensitive detector such as an infrared sensor, the temperature of the polishing pad can be monitored, and hence the condition at the polished surface can be roughly gauged. The second method also relies on the difference in friction coefficients between polishing a metallic layer and polishing a dielectric layer. This time, however, current the motor needed to drive the polishing table is measured instead, and the fluctuating motor current can serve as an index for appraising the extent of polish. Alternatively, current to the motor needed to drive the wafer carrier is used as an index to monitor the change in the frictional coefficient.

Through actual experiments, the method of monitoring the polishing state by sampling heat emitted from the polishing pad through an infrared sensor is found to have the best sensitivity when the polishing pad is spinning at a high speed and the slurry flow rate is low. On the other hand, when current supplied to the driving motor of the polishing table is used as an index for the polishing state, its sensitivity is closely related to the amount of down force applied to the polishing table. Alternatively, if current supplied to the driving motor of the wafer carrier is used as an index, its sensitivity is best when the polishing pad is rotating slowly while the wafer carrier is spinning at a high speed.

Figure 2:
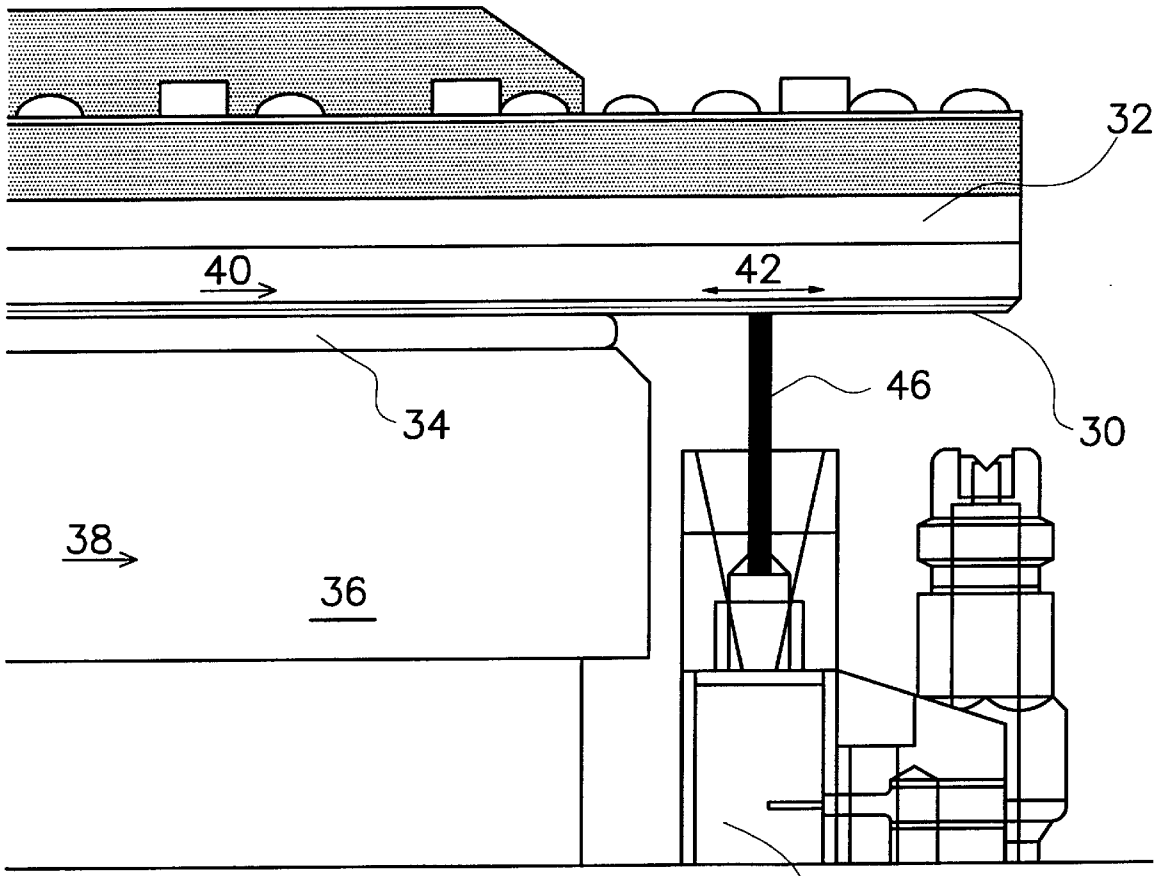
FIG. 2 (PRIOR ART)
FIG. 2 is a sketch of a reflectance spectra monitoring device installed next to a chemical-mechanical polishing station for monitoring wafer polishing operations.

The third method of monitoring the polishing state relies on an optical system. FIG. 2 is a sketch of a reflectance spectra monitoring device installed next to a chemical-mechanical polishing station for monitoring wafer polishing operations. As shown in FIG. 2, a conventional chemical-mechanical polishing station has a wafer carrier 32 capable of mounting a wafer 30, for example, through vacuum suction. The polishing station also has a polishing pad 34 mounted above a polishing table 36. In general, both the polishing pad 34 and the polishing table 36 are circular in shape and have a direction of rotation 38. The wafer 30 carried by the wafer carrier 32 is driven by a motor (not shown in the figure) in the direction 40. Besides rotating the wafer 30 under its grip, the wafer carrier 32 also oscillates the wafer forward and backward (in direction 42 as indicated), permitting a portion of the wafer surface to remain outside the polishing pad 34 for reflectance spectra scanning. When the wafer is outside the polishing pad 34, an optical polishing monitoring device 44 will send out a light beam 46 using, for example, a halogen lamp. Then, light reflected back from the surface of the wafer 30 will be collected for spectrum analysis.

Figure 3A:
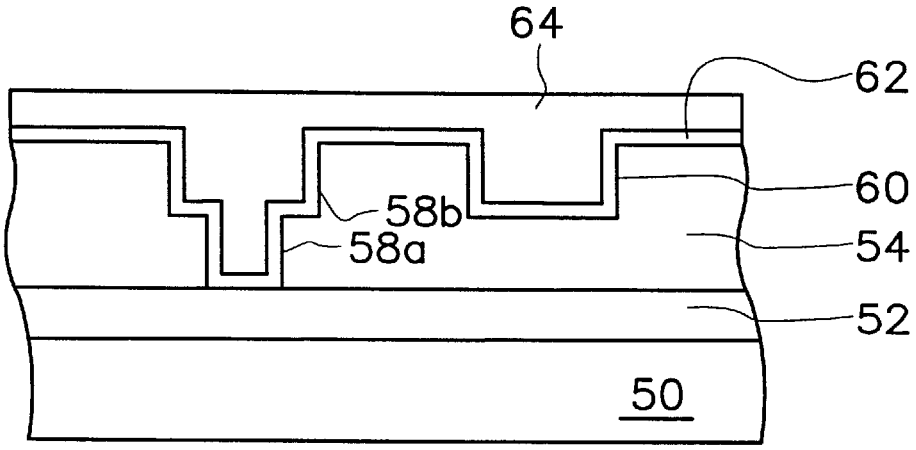
FIG. 3A (PRIOR ART)
FIG. 3A is a cross-sectional view showing a wafer having a dual damascene structure in an intermediate polishing stage.

FIG. 3A is a cross-sectional view showing a wafer having a dual damascene structure in an intermediate polishing stage. As shown in FIG. 3A, a metallic layer 52 such as aluminum is formed over a substrate 50, and then a dielectric layer 54 such as an oxide layer is deposited over the metallic layer 52. Thereafter, photolithographic and etching operations are conducted twice to form openings 58*a*, 58*b* and 60. The opening 58*a* acts as a via for coupling with the metallic layer 52, whereas a conductive material will be subsequently deposited into the openings 58*b* and 60 to serve as metallic interconnects.

Figure 3B:
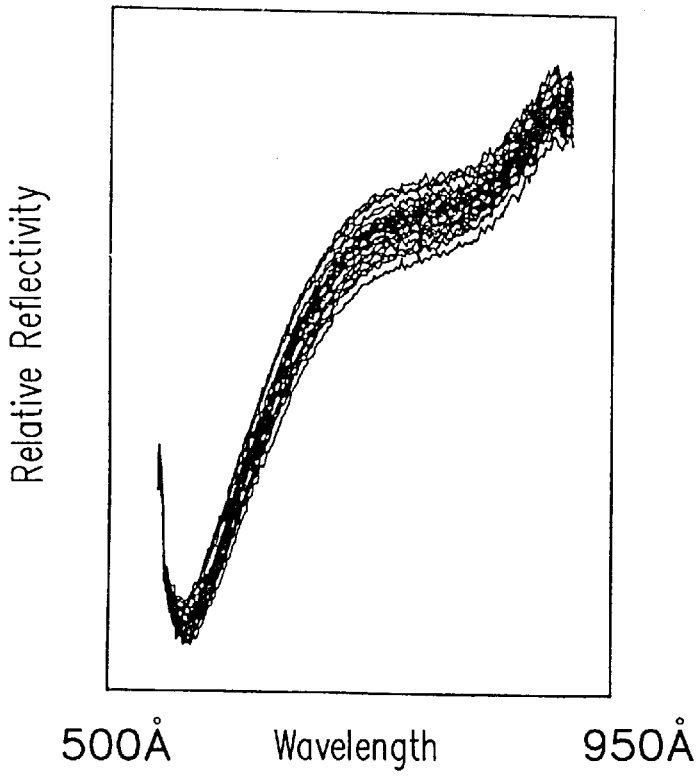
FIG. 3B (PRIOR ART)
FIG. 3B is the reflectance spectra obtained from the wafer surface when the wafer having a cross-sectional profile as shown in FIG. 3A is polished using a chemical-mechanical polishing station.

Next, a barrier layer 62, for example, a titanium nitride/titanium (TiN/Ti) composite layer is formed over the sidewalls and bottoms of the openings 58*a*, 58*b* and 60. Subsequently, metal such as tungsten is deposited to fill the openings 58*a*, 58*b* and 60 to form a metallic layer 64. Thereafter, the metallic layer 64 above the dielectric layer 54 is polished using a chemical-mechanical polishing method. FIG. 3B is the reflectance spectra obtained from the wafer surface when the wafer having a cross-sectional profile as shown in FIG. 3A is polished using a chemical-mechanical polishing station.

In the initial polishing stage, since the wafer surface is completely covered by the metallic layer 64, reflectivity is high and the reflectance line spectra is rather consistent. In FIG. 3B, the bandwidth range within which the optical polishing end point monitoring device sampled is from 500 Å to 950 Å (the horizontal axis in FIG. 3B), and the vertical axis shows the relative reflectivity. Relative reflectivity is the ratio of the reflectivity found at various wavebands over a base reflectivity obtained from a reference substrate surface. Since the relative reflectivity is just a ratio with respect to an arbitrary base, no units or values are marked on the side of the vertical axis. In fact, since a suitable base reflectivity can be chosen each time, different values for the relative reflectivity may be obtained.

However, the overall shape of the lines in the graph will be almost the same. The spectra as shown in FIG. 3B have altogether 30 reflectance line spectra. The reflectance spectra are sampled after the wafer has oscillated six times through the polishing pad. Note that there may be a certain degree of relative shifting between some of the 30 line spectra. This is caused by the variation of the background light source. In order to maintain a high level of precision of all the sampled data, relative reflectivity of the initially scanned wavelength of all line spectra are assumed to be the same; therefore, a reflectance spectra as shown in FIG. 3B is obtained.

Figure 4A:
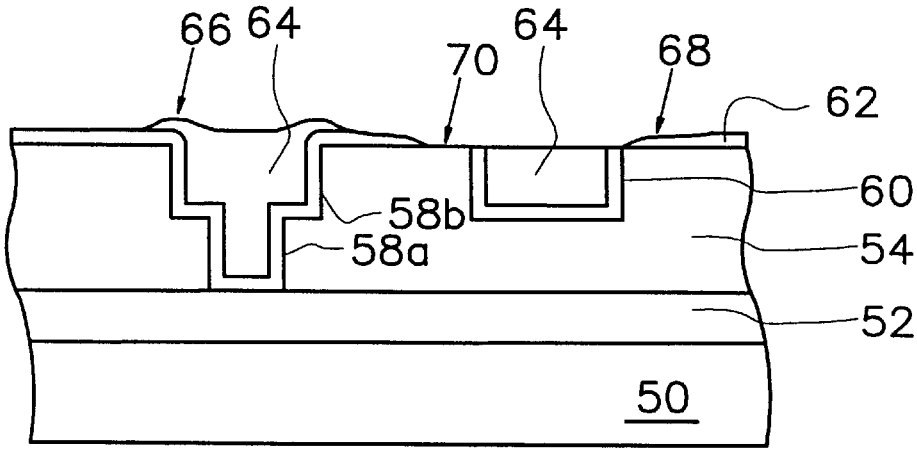
FIG. 4A (PRIOR ART)
FIG. 4A is a cross-sectional view showing a wafer having a dual damascene structure already chemical-mechanically polished right up to the barrier layer.
Figure 4B:
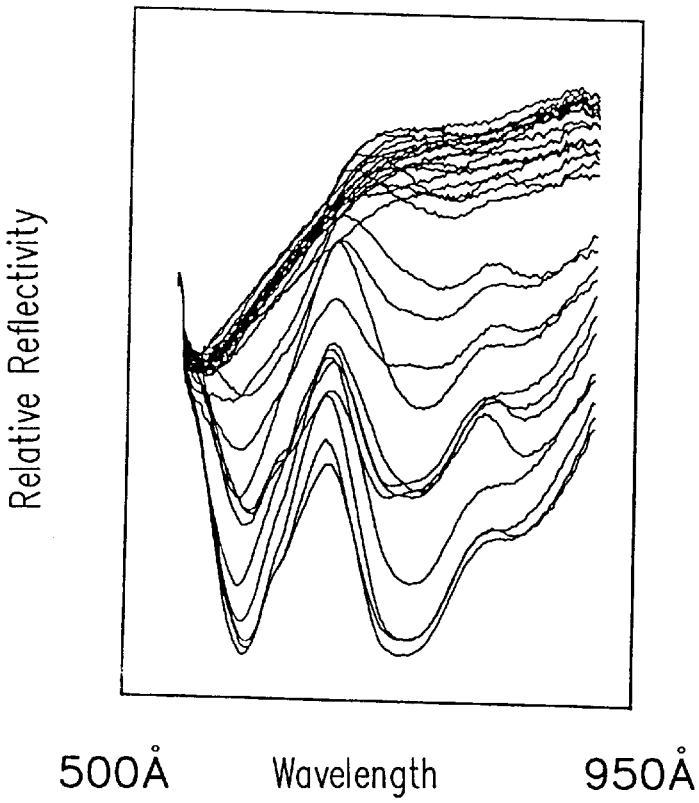
FIG. 4B (PRIOR ART)
FIG. 4B is the reflectance spectra obtained from the wafer surface when the wafer having a cross-sectional profile as shown in FIG. 4A is polished using a chemical-mechanical polishing station.

FIG. 4A is a cross-sectional view showing a wafer having a dual damascene structure already chemical-mechanically polished right up to the barrier layer, and FIG. 4B is the reflectance spectra obtained from the wafer surface when the wafer having a cross-sectional profile as shown in FIG. 4A is polished using a chemical-mechanical polishing station. During the polishing operation, polishing conditions will gradually change as the barrier layer 62 approaches. Polishing conditions will change because the slurry may be distributed unevenly and the metallic layer 64 may be intrinsically non-planar before the polishing operation.

Hence, the ideal 100% uniformity is impossible to obtain. Consequently, some residual metal from the metallic layer 64 will remain on top of the barrier layer 62 (indicated by arrow 66). Moreover, a portion of the barrier layer 62 (indicated by arrow 68) and a portion of the dielectric layer 54 (indicated by arrow 70) will be exposed. Therefore, reflectance spectra are somewhat dispersed due to a difference in reflectance spectra amongst metallic layer 64, barrier layer 62 and dielectric layer 54. The spectra as shown in FIG. 4B have altogether 30 reflectance line spectra. The reflectance spectra are sampled after the wafer has oscillated 28 times over the polishing pad.

Figure 5A:
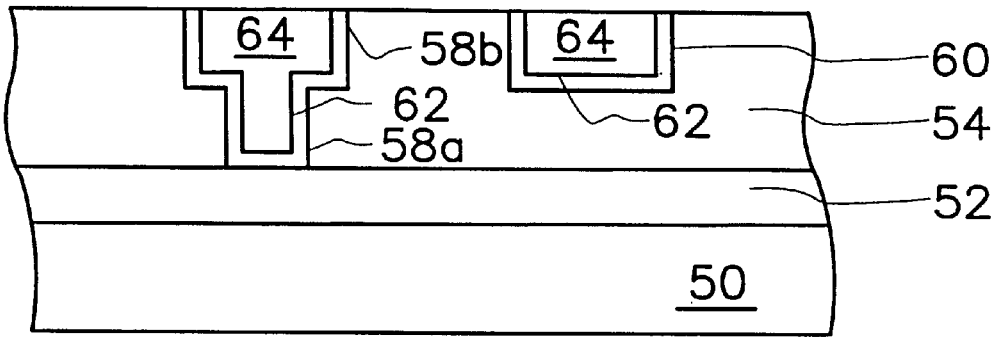
FIG. 5A (PRIOR ART)
FIG. 5A is a cross-sectional view showing a wafer having a dual damascene structure already chemical-mechanically polished right up to the dielectric layer.
Figure 5B:
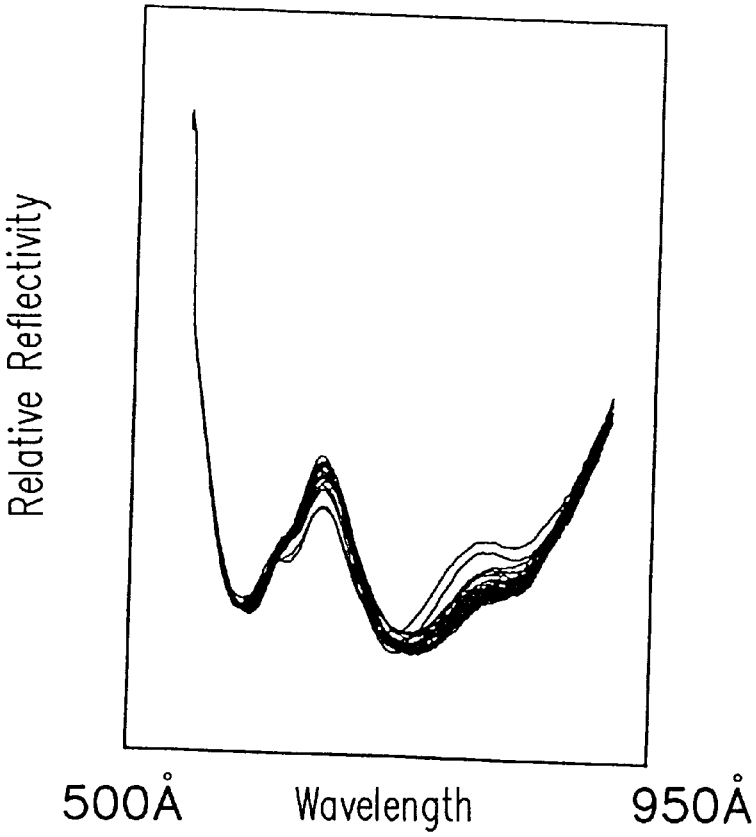
FIG. 5B (PRIOR ART)
FIG. 5B is the reflectance spectra obtained from the wafer surface when the wafer having the cross-sectional profile as shown in FIG. 5A is polished using a chemical-mechanical polishing station.

FIG. 5A is a cross-sectional view showing a wafer having a dual damascene structure already chemical-mechanically polished right up to the dielectric layer, and FIG. 5B is the reflectance spectra obtained from the wafer surface when the wafer having the cross-sectional profile as shown in FIG. 5A is polished using a chemical-mechanical polishing station. In wafer polishing, as soon as the dielectric layer 54 is reached, or when the dielectric layer 54 is slightly over-polished so that any residual metal from the metallic layer 64 is removed, reflectance spectra obtained from the wafer surface will mostly come from the dielectric layer 54.

Hence, reflectivity will have a lower value and distribution of the spectral lines will be more compact, as shown in FIG. 5B. The spectra as shown in FIG. 5B have altogether 30 reflectance line spectra. The reflectance spectra are sampled after the wafer has oscillated 41 times over the polishing pad.

Figure 6:
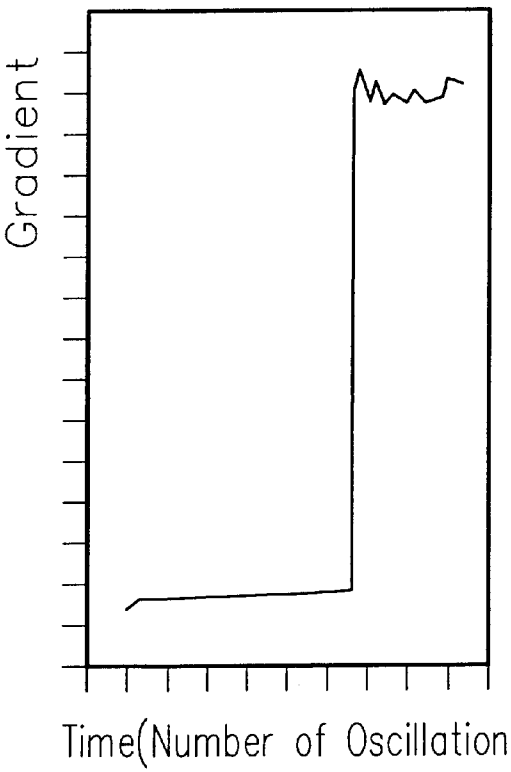
FIG. 6 is a graph showing the characteristic relationship of a reflectance spectra gradient at a fixed wavelength versus time (number of oscillations)

Conventionally, there are two modes of using reflectance spectra from a wafer surface to carry out polishing end point monitoring in a chemical-mechanical polishing operation. The two modes includes:

1. The curve obtained by plotting the gradient at a fixed wavelength position of the reflectance spectra against polishing time is used as an index in monitoring the surface condition of the wafer. FIG. 6 is a graph showing the characteristic relationship of the reflectance spectra gradient at a fixed wavelength versus time (number of oscillations). From observation, it is known that when polishing has gone far enough to be in the neighborhood of the barrier layer, there is a sharp increase in the value of the gradient. Hence, this position can be used as a reference for determining the polishing end point. However, the position of change is greatly affected by the choice of the fixed wavelength. Furthermore, repeatability from wafer to wafer is so low that reliability is a big issue for this method.

Figure 7:
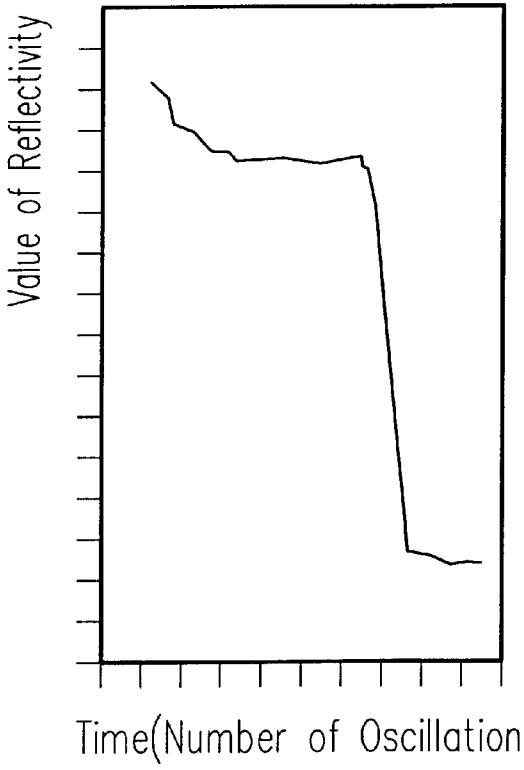
FIG. 7 is a graph showing the characteristic relationship of the value of reflectivity versus time (number of oscillations)

2. Values of reflectivity obtained from various periods are used as an index in monitoring the surface condition of the wafer. For example, by averaging the reflectivity for each wavelength in a given period and then adding their averages together to obtain a sum, the sums can be plotted against time. FIG. 7 is a graph showing the characteristic relationship of the value of reflectivity versus time (number of oscillations). As seen from FIG. 7, although there is an obvious fall in reflectivity as the barrier layer is approached, the slope is moderate and the fall is gradual. Consequently, it is very difficult to find an obvious polishing end point for the polishing operation. In addition, the result obtained by this monitoring method will be greatly influenced by external noise from various light sources, and hence reliability is rather low.

Note that the time referred to in FIGS. 6 and 7 can refer to the amount of polishing time or the number of oscillations of the wafer over the polishing pad once the polishing operation begins. Furthermore, the two aforementioned optical monitoring methods are capable of monitoring the polishing end point only. These two methods incapable of determining the degree of uniformity of the surface polished by the chemical-mechanical polishing station.

From careful analysis of the polishing operation, it is discovered that dispersion of the reflectance line spectra collected by scanning in a given period is dependent upon the polishing state. When the reflectance line spectra are collected from a pure metallic layer or a pure dielectric layer, the reflectance line spectra are close together. However, when polishing approaches the barrier layer, a portion of the metallic layer, barrier layer and dielectric layer will be exposed simultaneously. Since the reflectance spectra are different for each of the materials, distribution of the reflectance spectra is rather dispersed, thereby mirroring the non-uniformity of the wafer surface. Subsequently, as the barrier layer and the metallic layer above the dielectric layer are gradually removed, the reflectance spectra will slowly tighten up again. From this observation, the longer the period in which the reflectance spectra are dispersed, the longer will be the time necessary for removing residual barrier layer and metallic layer. In other words, there are recess regions on the wafer surface, and a longer polishing time is required to remove the barrier layer and the metallic layer within the regions; i.e., the degree of surface uniformity of the wafer surface is poor.

Based on the above observation, an innovative method of monitoring chemical-mechanical polishing is suggested. The method relies on forming a monitoring index based on the degree of dispersion of the reflectance spectra obtained from each polishing period. There are two convenient methods for calculating the degree of dispersion of the reflectance spectra in a given period in this invention, including:

1. For the 30 reflectance line spectra sampled from each period, the standard deviation of each waveband is calculated. Afterwards, these standard deviations are added together to form a sum. The sum is taken as a standard deviation parameter, which represents the degree of dispersion of the reflectance spectra in a given period.

2. For the 30 reflectance line spectra sampled from each period, the standard deviation of each waveband is calculated. By averaging these standard deviations, a standard deviation parameter that represents the degree of dispersion of the reflectance spectra in a given period is obtained.

Figure 8:
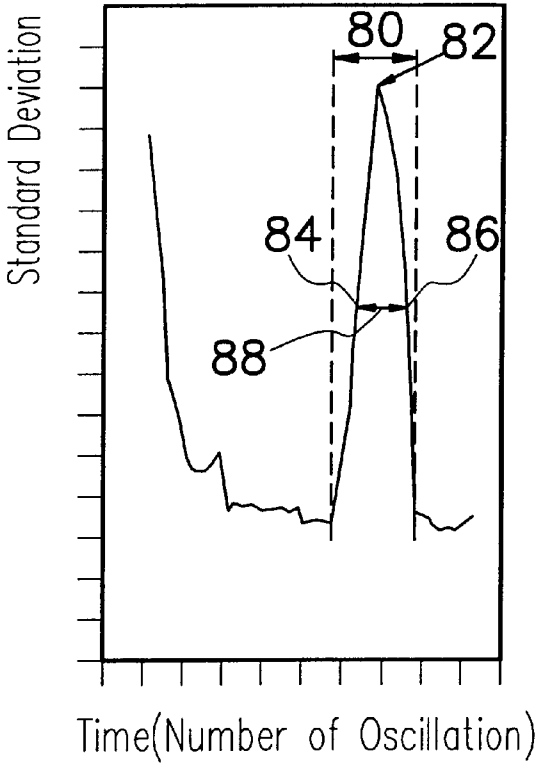
FIG. 8 is a graph showing the characteristic relationship of the standard deviation parameter versus time (number of oscillations).

FIG. 8 is a graph showing the characteristic relationship of the standard deviation parameter versus time (number of oscillations). Using one of the aforementioned methods for calculating the degree of dispersion, a standard deviation parameter in each period is calculated and plotted as a graph shown in FIG. 8. Subsequently, the characteristic curve can be used as an index in monitoring the chemical-mechanical polishing operation. The process of calculating the standard deviation parameter is not affected by interference from background light sources.

Furthermore, because there is no need to choose a particular waveband, repeatability from one wafer to the next is high. Hence, this method is very reliable. As shown in FIG. 8, standard deviation varies tremendously within the interval 80, reflecting an obvious change in the degree of dispersion in the reflectance spectra. In other words, this is the period when the barrier layer is approached. Within the interval 80, a peak value 82 is also generated. The peak value 82 can be used, as a monitoring index, for controlling how much longer polishing should be carried on. Moreover, it is also found that the wider the interval 80, the longer will be the period of polishing necessary in the neighborhood of the barrier layer.

In other words, the wafer is highly non-uniform and hence can serve as a base for checking the degree of surface uniformity. However, since the initial point and end point of the interval 80 is not too definite, two time nodes 84 and 86 at half the peak standard deviation value 82 are chosen. The interval 88 between the two time nodes 84 and 86 is then used as a monitoring index for the degree of surface uniformity. When the value of the interval 88 is large, the degree of uniformity of the polished wafer surface is poor. On the other hand, if the value of the interval 88 is small, residual metallic layer above the dielectric layer can be completely removed within a short polishing period, and the surface uniformity of the wafer is better. Therefore, the method of this invention not only is capable of precisely monitoring the polishing end point but also can detect polishing uniformity in situ through the degree of dispersion in the reflectance spectra.

A further point to note is that, although dual damascene processing is chosen as an illustration, the method used in this invention can be similarly applied to the polishing operations of other metallic layers. Moreover, the presence of the barrier layer is not strictly required. Furthermore, although two time nodes at half the peak value of standard deviation are chosen for arriving at an indexing interval, other cross points—at, for instance, ⅓, ¼ . . . of the peak value—can also be chosen.

In summary, major advantages of using the method of this invention include:

1. Utilization of the degree of dispersion of reflectance spectra sampled from a wafer surface as an index for monitoring the chemical-mechanical polishing operation can provide a higher repeatability between wafers, and hence can increase monitoring precision while a wafer is being polished.

2. Utilization of the degree of dispersion of reflectance spectra sampled from a wafer surface as an index in monitoring the chemical-mechanical polishing operation can obtain information regarding surface uniformity of a wafer in situ. Consequently, polishing parameters can be adjusted in real time so that the yield of the chemical-mechanical polishing operation can be increased.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A method of monitoring the end point of a chemical-mechanical polishing operation that can be applied to polish a metallic layer, comprising the steps of:

providing a substrate having a dielectric layer formed thereon, wherein the dielectric layer at least includes an opening such that metallic material is deposited to fill the opening and to cover the dielectric layer, hence forming a metallic layer;

performing a chemical-mechanical polishing operation on the metallic layer; and using a spectra detecting device to scan the substrate surface so as to collect a plurality of reflectance spectra back from the surface, then calculating a standard deviation parameter for each given period from the reflectance spectra, and finally using the peak value of the standard deviation parameter as an index value for determining the polishing end point.

2. The method of claim 1, wherein the standard deviation parameter is the sum of the standard deviations of the reflectivity in each waveband extracted from the reflectance spectra in a given period.

3. The method of claim 1, wherein the standard deviation parameter is the average of the standard deviations of the reflectivity in each waveband extracted from the reflectance spectra in a given period.

4. The method of claim 1, wherein the reflectivity includes a relative reflectivity.

5. The method of claim 1, wherein the initial values of all the reflectance spectra are assumed to be the same.

6. The method of claim 1, wherein between the metallic layer and the dielectric layer, a barrier layer is further included.

7. The method of claim 6, wherein the dielectric layer includes a silicon oxide layer, the metallic layer includes a tungsten layer, and the barrier layer includes a titanium/titanium nitride composite layer.

8. A method of monitoring the uniformity of surface in a chemical-mechanical polishing operation that can be applied to polish a metallic layer, comprising the steps of:

providing a substrate having a dielectric layer formed thereon, wherein the dielectric layer at least includes an opening such that metallic material is deposited to fill the opening and to cover the dielectric layer, hence forming a metallic layer;

performing a chemical-mechanical polishing operation of the metallic layer; and using a spectra detecting device to scan the substrate surface so as to collect a plurality of reflectance spectra back from the surface, then computing a standard deviation parameter in each given period from the reflectance spectra, then plotting the value of the standard deviation parameter in each period against a time parameter to obtain a graph, next using half the highest peak value of the standard deviation parameter in the curve to generate two time nodes, and finally using the interval between the two time nodes as an index value to monitor the degree of uniformity of the polished surface.

9. The method of claim 8, wherein the standard deviation parameter is the sum of the standard deviations of the reflectivity in each waveband extracted from the reflectance spectra in a given period.

10. The method of claim 8, wherein the standard deviation parameter is the average of the standard deviations of the reflectivity in each waveband extracted from the reflectance spectra in a given period.

11. The method of claim 8, wherein the reflectivity includes a relative reflectivity.

12. The method of claim 8, wherein the initial values of all the reflectance spectra are assumed to be the same.

13. The method of claim 8, wherein the time parameter is the polishing time, and the horizontal axis of the graph represents the time parameter while the vertical axis of the graph represents the standard deviation parameter.

14. The method of claim 8, wherein the time parameter is the number of scanning oscillations, and the horizontal axis of the graph represents the number of scanning oscillations while the vertical axis of the graph represents the standard deviation parameter.

15. The method of claim 8, wherein between the metallic layer and the dielectric layer, a barrier layer is further included.

16. The method of claim 15, wherein the dielectric layer includes a silicon oxide layer, the metallic layer includes a tungsten layer, and the barrier layer includes a titanium/titanium nitride composite layer.

* * * * *

UNITED STATES PATENT AND TRADEMARK OFFICE

CERTIFICATE OF CORRECTION

PATENT NO. : 6,153,116 
DATED : November 28, 2000
INVENTOR(S) : Ming-Cheng Yang, Feng-Yeu Shau, Cheng-Sung Huang and Champion Yi It is certified that error appears in the above-identified patent and that said Letters Patent is hereby corrected as shown below:

Title page,
Item [73], please replace Assignee "United Microelectronics Corp." to read -- "Promos Technologies Inc., Hsinchu, Taiwan; Mosel Vitelic Inc., Hsinchu, Taiwan; Siemens Ag., Munchen, Germany --

Signed and Sealed this

Twenty-third Day of July, 2002

*Attest:*

*Attesting Officer*

JAMES E. ROGAN
*Director of the United States Patent and Trademark Office*